US006162148A

United States Patent [19]

Lockwood et al.

[11] Patent Number: 6,162,148

[45] Date of Patent: Dec. 19, 2000

[54] POLE VAULT TRAINING DEVICE

[76] Inventors: Robert H. Lockwood, 18948 46th St., McLouth, Kans. 66054; Park A. Lockwood, 18340 1st St.; Bob A. Lockwood, 1813 Alabama St., both of Lawrence, Kans. 66044

[21] Appl. No.: 09/285,226

[22] Filed: Apr. 1, 1999

[51] Int. Cl.[7] ..... A63B 5/00

[52] U.S. Cl. ..... 482/14; 482/16; 482/18

[58] Field of Search ..... 482/14–18, 23, 482/25, 33, 34, 38, 148

[56] References Cited

U.S. PATENT DOCUMENTS

| | | | |
|---|---|---|---|
| 2,960,335 | 11/1960 | Shuttleworth . | |
| 3,012,778 | 12/1961 | Whittaker et al. . | |
| 3,825,252 | 7/1974 | Gieger | 482/129 |
| 3,940,137 | 2/1976 | Taylor . | |
| 4,017,070 | 4/1977 | Hilton . | |
| 4,674,743 | 6/1987 | Hirano . | |
| 4,778,174 | 10/1988 | Tolsma . | |

*Primary Examiner*—Glenn E. Richmon
*Attorney, Agent, or Firm*—Joseph N. Breaux

[57] ABSTRACT

An apparatus used to train pole vaulters to practice the swing and stretch of the vault from the pole plant and bend phase to the inversion phase which includes an upside down "U" shaped tube member with two short extensions protruding from a top surface of the upside down "U" shaped tube with steel straps extending from each extension with handles attached to the end of steel straps, the "U" shaped tube, extension and straps and grips are positioned so that the handles hang parallel, level but offset from each other about eight inches. The "U" shaped tube is swingingly attached to the horizontal bar by the use of velcro straps while a cloth mat is provided between the "U" shaped and the horizontal bar allowing the "U" shaped tube to swing freely around the horizontal bar. Safety wrist straps are attached to the hand grips assuring the athlete's safe grip during the training. The device provides a training tool for the swing phase of the pole vault without unnecessary delay or danger created by many repetitions of the run, pole plant, leg drive, and swing.

3 Claims, 4 Drawing Sheets

POLE VAULT TRAINING DEVICE

TECHNICAL FIELD

The present invention relates to devices and methods for sports training and more particularly to a pole vault training device that

BACKGROUND ART

In order to develop important motor skills for pole vaulting, a student and teacher must rely upon repetitious vaulting conducted at a pole vault pit and which includes the run, pole plant, leg drive, hang and swing. Numerous vaults for a beginner are difficult to perform given the duration of each vault, and, furthermore, the practice may become dangerous as the student becomes fatigued. Habitualizing the proper technique for the hang, swing and stretch would greatly increase the efficiency of a vaulter's practice. Prior to the present invention there has never been a device which helps a vaulter habitualize the movements involved during the hang, swing and stretch phase of the vault away from the pole vault pit and without performing the complete vault. The present invention provides a tremendous way to train for a vaulter without unnecessary delay or danger created by the numerous repetitions of the run, pole plant, leg drive and swing. Coaches and athletes both benefit by the use of the present invention which provides strength, flexibility and agility enhancement as well as timing and technique development for the vaulter. Multiple repetitions in every practice are invaluable and effective in creating proper vaulting techniques. Additionally, prior to the present invention there has never been a safe and easy to use device for pole vault training that is accomplished away from the vaulting pit.

Prior art patents include the following:

Tolsma U.S. Pat. No. 4,778,174 which discloses a pole vault simulator device.

Hirano U.S. Pat. No. 4,674,743 which discloses an athletic training unit with musical rhythm reproducing speaker and exerciser's pulse detecting means.

Hilton U.S. Pat. No. 4,017,070 which discloses a training device for pole vaulters.

Taylor U.S. Pat. No. 3,940,137 which discloses a pole vaulting game apparatus.

Whittaker et al U.S. Pat. No. 3,012,778 which discloses a gymnastic apparatus.

Shuttleworth U.S. Pat. No. 2,960,335 which discloses an exercising device.

As can be seen from the prior patents there has never been an invention as the present which provides a safe and effective apparatus which assists in the training and coaching of a pole vaulter for the movements and strength during the hang, swing and stretch phase of a vault.

GENERAL SUMMARY DISCUSSION OF INVENTION

It is thus an object of the invention to provide a pole vault training device that provides a tremendous training tool for habitualizing the movements performed during the hang, swing and stretch phase of the pole vault without unnecessary delay or danger created by many repetitions of the run, pole plant, leg drive and swing.

It is a further object of the invention to provide a pole vault training apparatus that provides a method and apparatus for increasing the strength, flexibility and agility as well as timing and technique development for a pole vaulter.

It is a still further object of the invention to provide a pole vault training apparatus which fits on a standard horizontal bar and is supported by upside down "U" shaped tube with a pad between the tube and the horizontal bar, two securing straps with hook and pile fasteners secure the tube to the horizontal bar and allow the tube to swing freely around the bar, two steel straps extended from opposing sides of a top surface of the upside down "U" shaped tube, hand grips are attached to the end of each strap, and hang parallel and offset from each other. The unit is perpendicular to the bar in use.

Accordingly, a pole vault training apparatus is provided that comprises an upside down "U" shaped tube member about six to seven inches long and with a diameter that allows it to easily fit over a horizontal gymnastic bar with a pad positioned between the tube and the bar, a pair of securing straps are attached to the tube and extend around the tube and the horizontal bar to securely attach the tube to the bar but allowing the tube to swing freely on the bar, two steel support straps extend in opposing directions from a top surface of the tube and are angled downwardly and which provide grips and a pair of wrist straps that extend from a bottom surface of the tube and for assuring the grip of the user.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from the preceding following description that an athlete desiring to train for the pole vault event would use the pole vault training apparatus as a safe, high repetition practice for the straight arm swing, stretch, and leg drive by swinging forward and backwards simulating the swing after the pole plant. The athlete could gain considerable strength, flexibility, and technique in a critical phase of the pole vault without the use of the run, pole plant and leg drive. The athlete would place the cloth pad around the horizontal bar, set the "U" shaped tube part of the pole vault training apparatus on the pad, wrap the securing velcro straps around the horizontal bar securing the apparatus to the bar, adjust the wrist straps and begin swinging. The athlete can adjust his or her grip to their comfort and may touch their feet on the mat or floor under the horizontal bar. The swing forward is always initiated by the take off foot, knee drive, and straight arm swing. Coaches or assistants may assist the user during the forward swing. The athlete will ingrain proper technique for the initial swing (drag) of the vault in a controlled and safe manner away from the pole vault runway and pit, and the development of grip and pull strength, quickness and shoulder flexibility will be tremendously increased. The pole vault training apparatus easily fits on a standard horizontal bar indoors or outdoors and may be used for gymnastics or strength training found in gyms and playgrounds at numerous locations.

Figure 1:
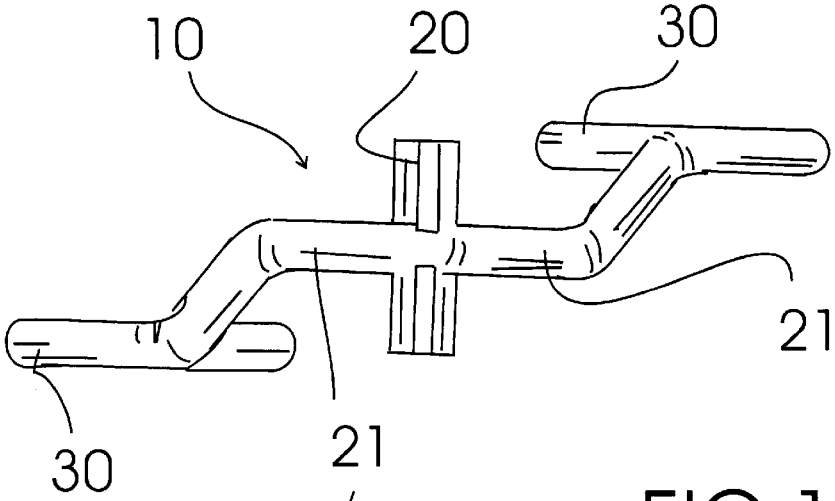
FIG. 1 is a top plan view of an exemplary embodiment of the pole vault training device of the present invention.
Figure 2:
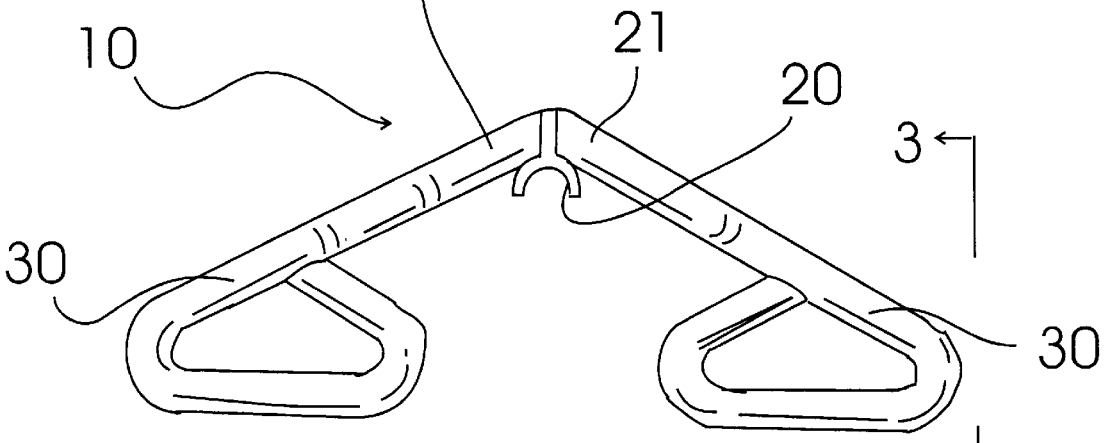
FIG. 2 is a left side plan view of the pole vault training device of FIG. 1.
Figure 3:
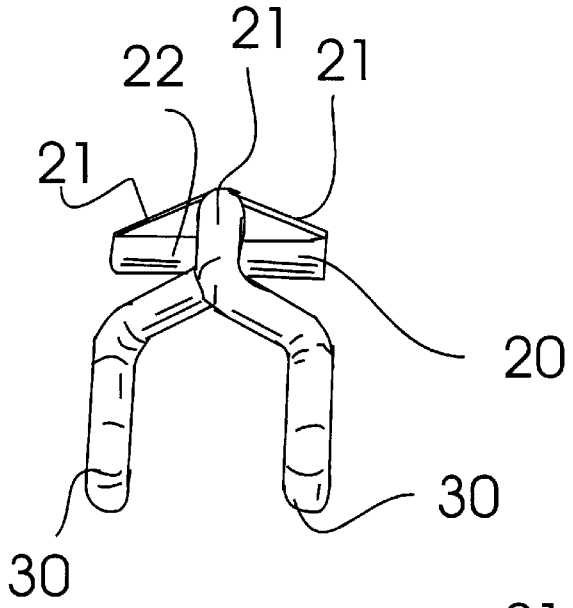
FIG. 3 is an end plan view of the pole vault training device of FIG. 1.

Referring to FIGS. 1–8 in general, the pole vault training apparatus 10 is illustrated generally in FIG. 1. The apparatus 10 includes an upside down "U" shaped tube 20 which is used to attach the apparatus to a horizontal bar. The horizontal bar preferably includes a standard gymnastic horizontal bar either indoors or out, and preferably positioned high enough from the floor or ground to allow the athlete to swing freely without contacting the ground but low enough so the athlete can touch the ground by extending his or her foot. The "U" shaped tube 20 includes two extending members 21 which extend in opposing directions and angle downwardly from a top surface 22 of the "U" shaped tube 20. The extending members 21 are preferably welded to the upper surface 22 and extend about two to about five inches from the top surface 22. The "U" shaped tube is preferably about one and a quarter inches in internal diameter and approximately six and a half inches long. The diameter must be of appropriate size to allow the tube 20 along with a pad 23 to snugly fit on the horizontal bar 25 and remain free to swing once attached. The tube 20 may vary in diameter depending upon the diameter of the horizontal tube to be attached. The length of the "U" shaped tube may vary without departing from the intent and purpose of the invention, however the inventors have found that six and a half inches is the preferable length since this dimension provides an easy to attach and easy to store apparatus. The extended portions 21 provide a support and separation mechanism for a pair of steel grips 30. The longitudinal axis of the tube 20 is the direction which the horizontal bar will be placed within the "U" shaped tube. The extension members 21 also provide a means for separating the steel grips 30. It is preferable that all metal pieces of the apparatus, which include the "U" shaped tube 20 and extensions 21 have oval edges to prevent snagging and possible cuts to the athlete and the athletic equipment. The two straps 35 are approximately ten inches long and loop around the U-shaped tube 20 and the horizontal bar 25. Each of the straps 35 extend around the tube and the horizontal bar. Each hand grip 30 is approximately twelve to about nine inches long and has a gripping surface of about nine to about seven inches long. The hand grips 30 are constructed of steel. Safety straps 31 are provided on each hand grip 30 and are used to wrap around an athlete's wrist after the athlete has a firm grip on the hand grip 30. The safety straps 31 assure that the athlete's grip does not slip so that the athlete may perform repetitious movements without the worry of losing grip when fatigued.

Figure 5:
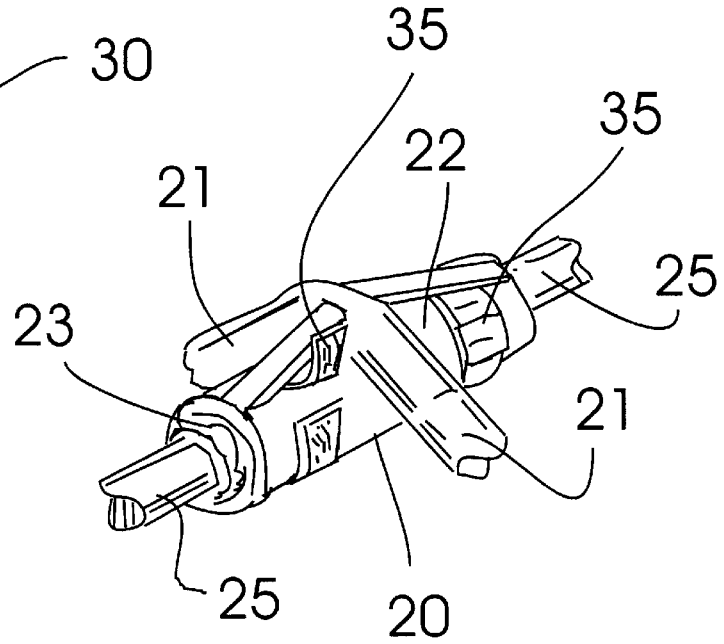
FIG. 5 is a detail perspective view showing the pad wrapped around a section of a representative horizontal support rod and installed within the "U" shaped tube.
Figure 4:
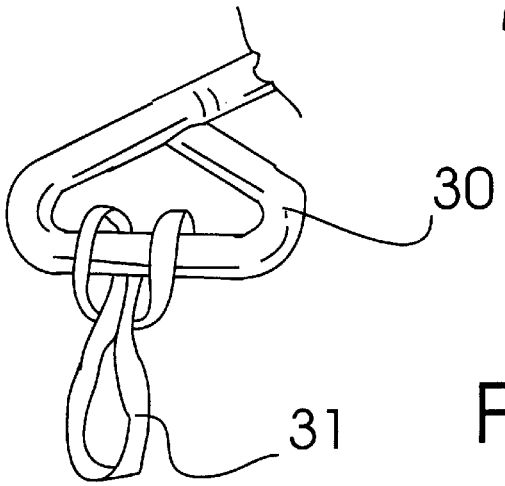
FIG. 4 is a detail plan view showing one of the handles with the safety strap attached thereto.
Figure 6:
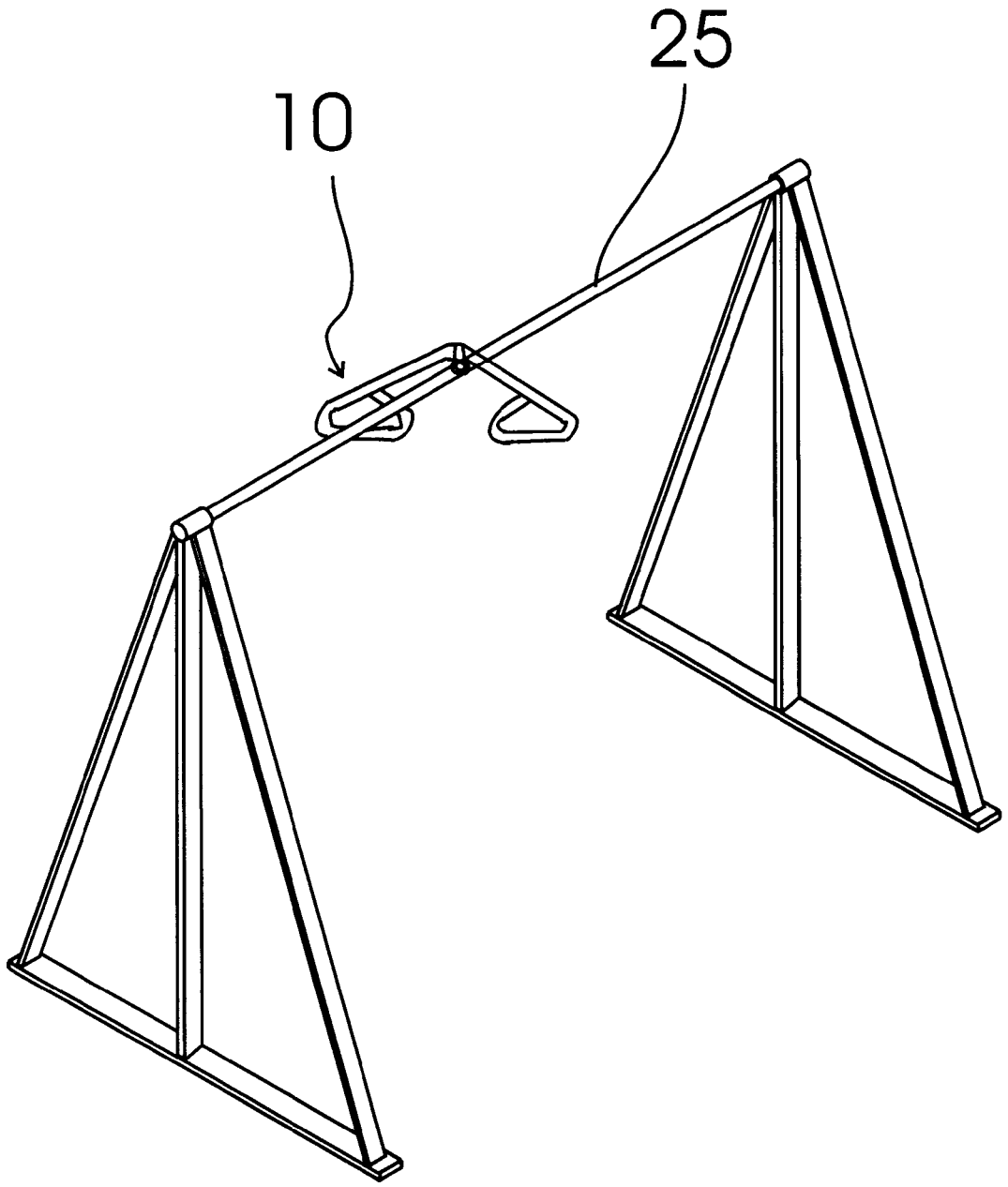
FIG. 6 is a perspective view showing the exemplary pole vault training device installed on a representative horizontal bar ready for use.
Figure 7:
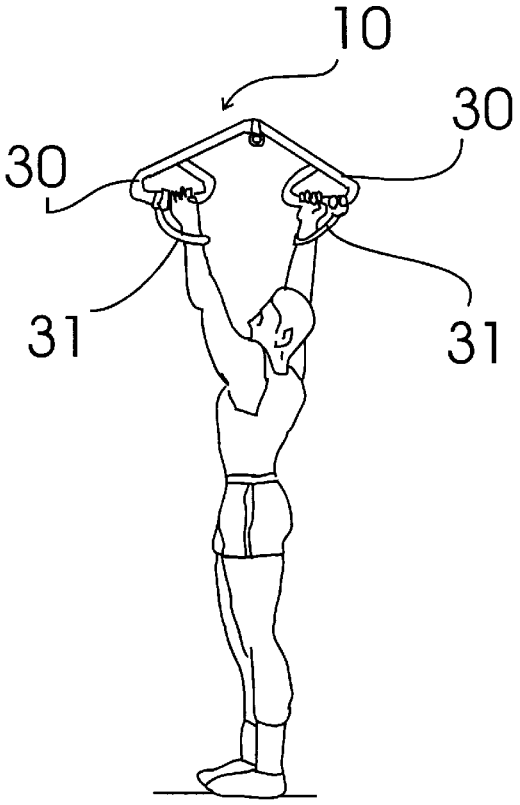
FIG. 7 is a side plan view showing a representative user in the standing position with the wrists of the user positioned through the safety straps, the hands each gripping a handle, and both feet placed on the ground.
Figure 8:
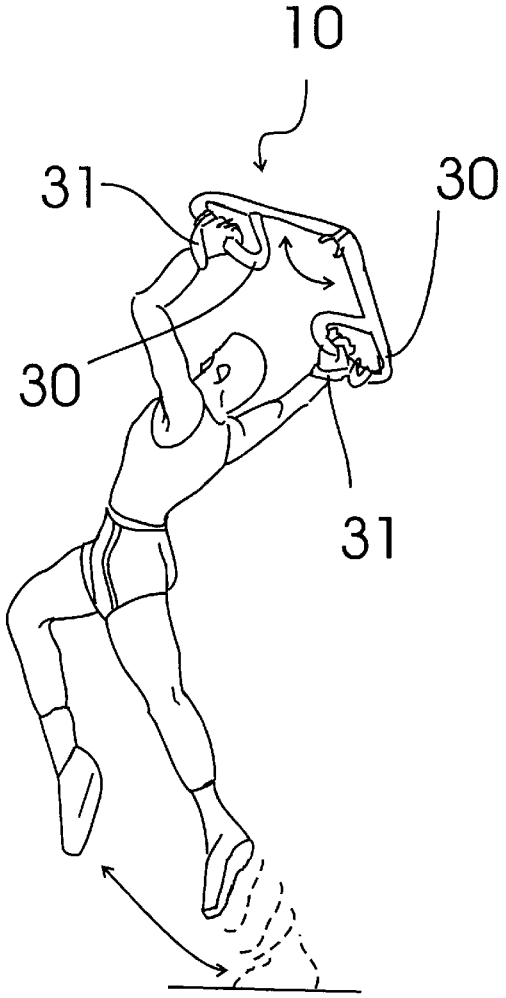
FIG. 8 is a side plan view showing the user pushing off with his left foot during use of the training device.

FIG. 5 illustrates the "U" shaped member 20 and the "U" shaped member pad 23. Pad member 23 is preferably of a cotton cloth material that will help the "U" shaped member 20 swing freely on horizontal bar 25 once secured in position with the securing straps 35. The pad member 23 also prevents scratching on the horizontal bar 25 while the pole vault training apparatus 10 is in use. The pad member 23 is rectangular in shape and preferable slightly longer than the length of the upside "U" shaped member and wide enough to almost wrap completely around the horizontal bar 25 once. A pair of velcro straps 35 are securely attached to the upper surface 22 of the "U" shaped member and the velcro straps 35 are wrapped around the horizontal bar 25 in order to provide a securing means for attaching the training apparatus 10 to the horizontal bar 25.

The "U" shaped tube member 20 and the extension members 21 have a general configuration of a triangle with the addition of the strap angling downwardly from the top surface creates a triangle which is approximately thirteen inches in height and thirty-three inches in length. The hand grips 30 and extension pieces 21 are also arranged to position the hand grips 30 parallel to each other at the same level, but are offset with respect to each other. The hand grips 30 are offset approximately eight inches. A separate unit 10 with opposite mirror image construction details is required for left handed vaulters.

It is noted that the embodiment of the pole vault training device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pole vault training device adaptable to be attached to a horizontal gymnastic bar, the device comprising:

a) an upside "U" shaped tube member adaptable to fit on a horizontal gymnastic bar, b) a pad member positioned between an interior of the "U" shaped member and horizontal gymnastic bar, c) a pair of extension members securely attached to an upper surface of the upside down "U" and each extension member extends in opposing directions but both angled downwardly from the upper surface of the upside down "U" shaped member about two to about five inches, d) a pair of securing straps each fixedly attached to an upper surface of the upside down "U" shaped member and each positioned near opposing ends of the "U" shaped member, the securing straps provide a means for securing the "U" shaped tube member to the horizontal bar, and d) a wrist securing strap positioned on each hand grip which is wrapped around the hand of a user to insure a safe grip during use.

2. The pole vault training device of claim 1, wherein the upside down "U" shaped tube member further comprises a tube member which is about six and one half inches long and has an internal diameter larger than the diameter of the horizontal bar but small enough to hold the pad between the interior of the "U" shaped tube member and the horizontal bar but allowing the "U" shaped member to swing freely around the horizontal bar once secured by the pair of securing straps.

3. The pole vault training device of claim 1, wherein the pad member further comprises a pad member shaped as a rectangle and dimensioned to extend a length of the "U" shaped tube member and wide enough to wrap around the horizontal bar once.

* * * * *